US009033731B2

(12) United States Patent
Malek et al.

(10) Patent No.: US 9,033,731 B2
(45) Date of Patent: May 19, 2015

(54) GROUNDING CLAMP

(71) Applicant: Apple, Inc., Cupertino, CA (US)

(72) Inventors: Shayan Malek, San Jose, CA (US); Jared M. Kole, San Jose, CA (US); Richard H. Dinh, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 269 days.

(21) Appl. No.: 13/632,126

(22) Filed: Sep. 30, 2012

(65) Prior Publication Data

US 2014/0011399 A1 Jan. 9, 2014

Related U.S. Application Data

(60) Provisional application No. 61/668,405, filed on Jul. 5, 2012.

(51) Int. Cl.

| | |
|---|---|
| ***H01R 24/50*** | (2011.01) |
| *H01R 4/02* | (2006.01) |
| *H01R 9/05* | (2006.01) |

(52) U.S. Cl.

CPC ..... *H01R 9/0524* (2013.01); *H01R 4/023* (2013.01); *H01R 9/0515* (2013.01)

(58) Field of Classification Search

USPC ..... 439/92–99, 101, 108; 248/71, 74.2, 248/316.7, 222.12, 220.31, 229.26; 174/40 R, 40 CC, 70 A

See application file for complete search history.

(56) References Cited

U.S. PATENT DOCUMENTS

| | | | | | |
|---|---|---|---|---|---|
| 2,553,883 | A | * | 5/1951 | Tinnerman | 248/74.3 |
| 3,194,524 | A | * | 7/1965 | Trumbull | 248/74.2 |
| 3,486,531 | A | * | 12/1969 | Nalodka | 138/103 |
| 4,042,198 | A | * | 8/1977 | Takeuchi | 248/62 |
| 4,325,598 | A | * | 4/1982 | Leonardo | 439/98 |
| 4,856,739 | A | * | 8/1989 | Takikawa | 248/74.2 |
| 4,958,792 | A | * | 9/1990 | Rinderer | 248/74.2 |
| 4,989,822 | A | * | 2/1991 | Fannon | 248/632 |
| 4,991,801 | A | * | 2/1991 | Trumbull | 248/74.2 |
| 5,124,889 | A | * | 6/1992 | Humbert et al. | 361/818 |
| 5,163,643 | A | * | 11/1992 | Auclair | 248/61 |
| 5,364,051 | A | * | 11/1994 | Philpot | 248/229.26 |
| 5,639,049 | A | * | 6/1997 | Jennings et al. | 248/74.2 |
| 5,949,020 | A | * | 9/1999 | Mitchell et al. | 174/40 CC |
| 6,362,425 | B1 | * | 3/2002 | Chilton et al. | 174/51 |
| 6,846,986 | B1 | * | 1/2005 | Ravid et al. | 174/51 |
| 6,877,996 | B1 | * | 4/2005 | Franks, Jr. | 439/92 |
| D538,142 | S | * | 3/2007 | Heary, Sr. | D8/383 |
| 7,306,476 | B2 | * | 12/2007 | Gerlich et al. | 439/394 |
| 7,354,283 | B2 | * | 4/2008 | Onuma et al. | 439/92 |
| 7,559,777 | B2 | * | 7/2009 | Lin et al. | 439/108 |
| 8,192,209 | B1 | * | 6/2012 | Li et al. | 439/98 |
| 8,337,220 | B2 | * | 12/2012 | Powell | 439/98 |
| 8,472,169 | B2 | * | 6/2013 | Sun | 361/679.02 |
| 2008/0143635 | A1 | * | 6/2008 | Lin et al. | 343/906 |

* cited by examiner

*Primary Examiner* — Briggitte R Hammond

(74) *Attorney, Agent, or Firm* — Womble Carlyle Sandridge & Rice, LLP

(57) ABSTRACT

A clamping apparatus includes a base, a vertical support member coupled to the base, and a head member coupled to the vertical support member. The head member is configured to receive and engage a portion of a coaxial cable. Additionally, the base is configured to engage through a through hole or slot arranged through a substrate and provide electrical communication between a portion of the coaxial cable and the substrate.

20 Claims, 8 Drawing Sheets

GROUNDING CLAMP

CROSS-REFERENCE TO RELATED APPLICATIONS

This application claims the benefit of U.S. Provisional Patent Application No. 61/668,405, filed Jul. 6, 2012 and entitled "GROUNDING CLAMP" by MALEK et al., which is incorporated by reference in its entirety for all purposes.

FIELD OF THE DESCRIBED EMBODIMENTS

The described embodiments relate generally grounding of coaxial cables, and more particularly, to multipurpose clamping apparatuses configured to ground and structurally support coaxial cables.

BACKGROUND

Conventionally, coaxial cables may be used for signal transmission throughout a personal electronic device, for coupling of one or more antennas to circuit elements of the device, and for many other purposes. Coaxial cables generally include an inner signal transmission medium and an outer coaxial shield. If used as a signal transmission medium, it is generally good practice to ensure good electrical contact between the outer coaxial shield and a ground terminal connection, for example, a metallic housing or connector connecting the inner signal transmission medium to a component. The inner signal transmission medium is generally effective if a fairly stable ground connection is provided and if kinks or sharp turns and creases are avoided in the physical routing of the cable to avoid internal strain.

However, as electronic devices become more and more diverse, a number of external signal sources supplied to the devices may increase, and thus provide additional sources of electrical interference. Therefore, it may become increasingly important to ensure a stable ground connection to reduce interference while also ensuring a stable physical routing of coaxial cables to reduce signal losses due to internal strain.

SUMMARY OF THE DESCRIBED EMBODIMENTS

This paper describes various embodiments that relate to clamping apparatuses for supporting and routing coaxial cable about a substrate. The clamping apparatuses may provide electrical communication between a portion of the coaxial cable and the substrate, for example, through grounding a portion of the cable.

According to one embodiment of the present invention, a clamping apparatus includes a base, a vertical support member coupled to the base, and a head member coupled to the vertical support member. The head member is configured to receive and engage a portion of a coaxial cable. Additionally, the base is configured to engage through a through hole or slot arranged through a substrate and provide electrical communication between a portion of the coaxial cable and the substrate.

According to one embodiment of the invention, a grounding system includes a substrate having at least one slot formed therethrough, the slot being arranged proximate an exposed layer of copper electrically connected to a ground path of circuitry arranged on the substrate. The grounding system further includes a clamping apparatus comprising a base, a vertical support member coupled to the base, and a head member coupled to the vertical support member. The head member is configured to receive and engage a portion of a coaxial cable. Furthermore, the base is configured to engage through the at least one slot and provide electrical communication between a portion of the coaxial cable and the ground path.

According to one embodiment of the invention, a method of grounding a coaxial cable to a substrate includes stripping a portion of an outer jacket of the coaxial cable to expose a coaxial shield portion of the coaxial cable, engaging a head member of a clamping apparatus to both the exposed coaxial shield and the outer jacket of the coaxial cable, engaging a base of the clamping apparatus to a slot formed through the substrate proximate a ground path, the base configured to provide electrical communication between the coaxial shield of the coaxial cable and ground path, applying conductive chemistry between the base of the clamping apparatus and the substrate.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION OF SELECTED EMBODIMENTS

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Figure 1:
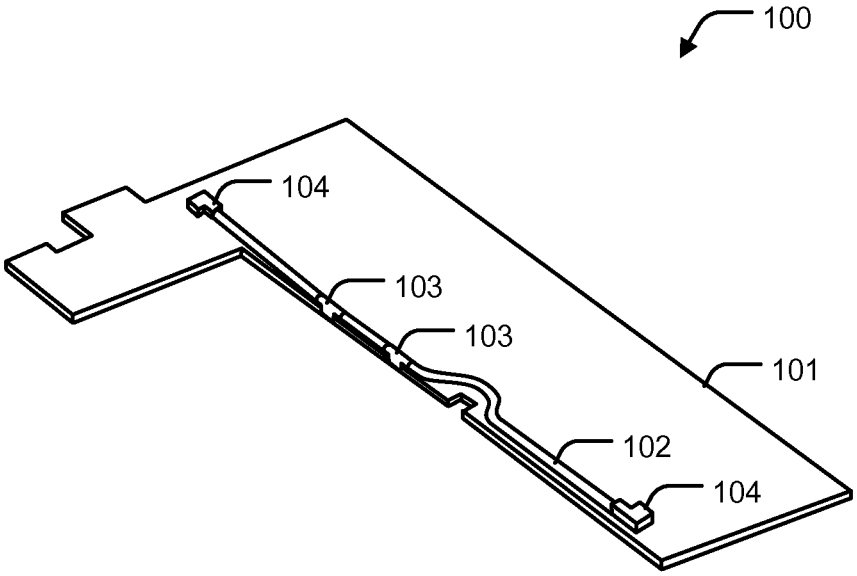
FIG. 1 is a perspective view of substrate with routed coaxial cable, according to an exemplary embodiment of the present invention.

Turning to FIG. 1, a perspective view 100 of substrate 101 with routed coaxial cable 102 is illustrated, according to an exemplary embodiment of the present invention. As shown, the coaxial cable 102 is arranged proximate an outer surface of the substrate 101, and is engaged with a plurality of grounding clamps 103. According to at least one exemplary embodiment of the present invention, the substrate 101 is a printed circuit board with at least one circuit trace arranged thereon or therein. Further, terminal connectors 104 provide for electrical contact between a signal transmission portion of the cable 102 and circuit elements of the substrate 101. For example, terminal connectors 104 may be any suitable connectors, including miniature coaxial radio frequency (RF) connectors, Hirose U.FL, W.FL, H.FL, IPEX MHF, IPEX MHF2, IPEX MHF3, IPEX MHF4, Murata GSC and HSC connectors. It should be understood that this listing is not limiting, and any suitable connector may be applicable to any desired implementation of the present invention.

The grounding clamps 103 provide both structural support for the cable 102 and a ground path between a coaxial shield portion of the cable 102 and a ground terminal or electrode of the substrate 101.

Figure 2:
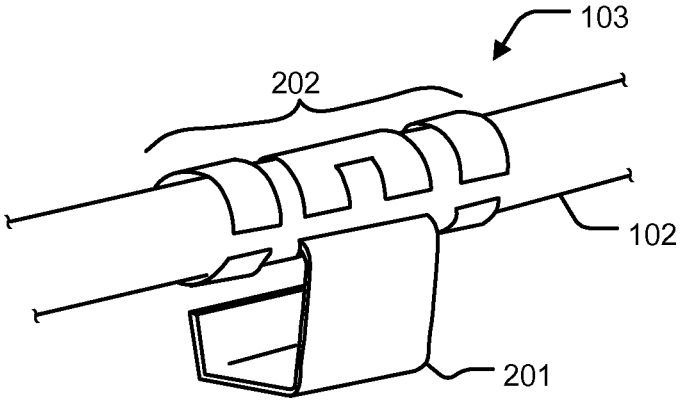
FIG. 2 is a perspective view of a grounding clamp, according to an exemplary embodiment of the present invention.

FIG. 2 is a perspective view of the grounding clamp 103, according to an exemplary embodiment of the present invention. As illustrated, the clamp 103 comprises a base member 201 and a ferrule-like head member 202. The base member 201 may be integrally formed along with the head member 202, for example, through bending of a single piece of material. According to at least one exemplary embodiment of the present invention, the entire grounding clamp 103 is formed of a piece of sheet metal through a bending process. According to some exemplary embodiments of the present invention, grounding clamp 103 is formed of a piece of sheet metal through one or more metal-working processes. The metal-working processes may include at least one of bending, curling, drawing, incremental forming, thinning, punching, stamping, pressing, or any other suitable process.

Hereinafter, a more detailed description of individual portions of both the head member 202 and the base member 201 are provided with reference to FIGS. 3A, 3B, 4A, and 4B.

Figure 3A:
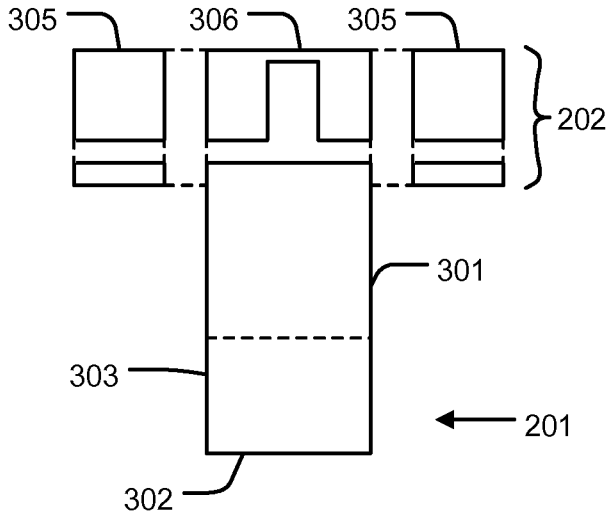
FIG. 3A is a front elevation view of the grounding clamp of FIG. 2.

FIG. 3A is a front elevation view of the grounding clamp 103. As shown, the base member 201 comprises a base 302, a vertical support member 301 coupled to the base 302, and an oblique riser 303 coupled to the base. The oblique riser 303 is illustrated more clearly in FIGS. 4A-4B. As also shown, the head member 202 comprises three main ferrule-like formations, outer formations 305 and inner formation 306. Each outer formation 305 is a generally cylindrical formation configured to receive and engage an outer jacket of a coaxial cable. The inner formation 306 is a generally cylindrical formation configured to receive, engage, and be in electrical communication with a coaxial shield portion of coaxial cable. As the entire clamp 103 may be formed of a conductor such as metal, it should be readily understood that a conductive path is formed between the coaxial shield portion of the coaxial cable and oblique riser 303.

Figure 3B:
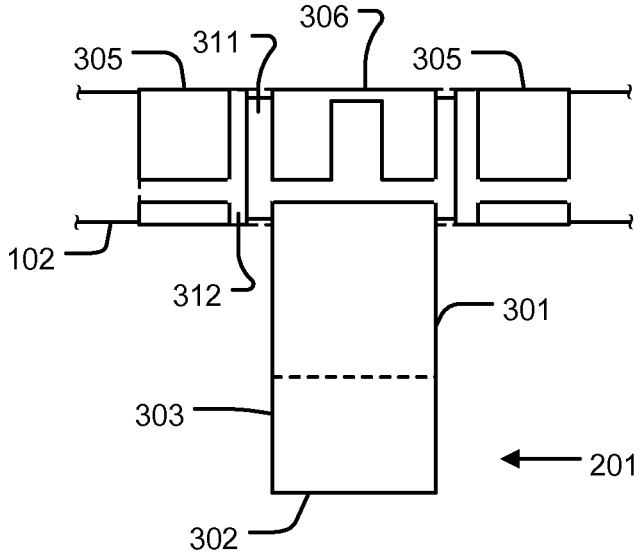
FIG. 3B is a front elevation view of the grounding clamp of FIG. 2 supporting coaxial cable.

FIG. 3B is a front elevation view of the grounding clamp 103 supporting coaxial cable. As shown, each outer formation 305 is configured to receive and engage outer jacket 312 of coaxial cable 102. The inner formation 306 is configured to receive, engage, and be in electrical communication with coaxial shield portion 311 of coaxial cable 102.

Figure 4A:
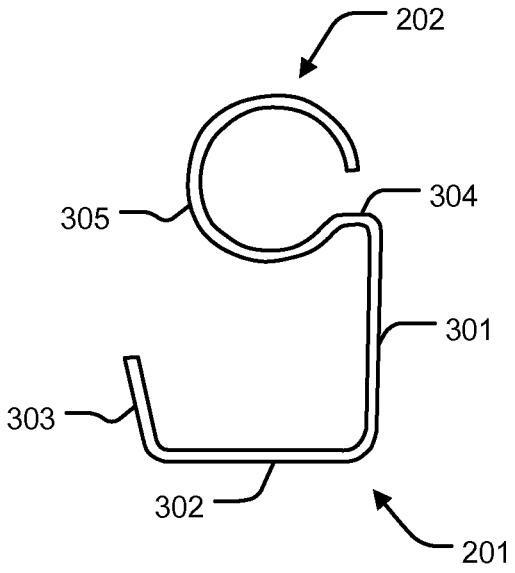
FIG. 4A is a side elevation view of the grounding clamp of FIG. 2.

FIG. 4A is a side elevation view of the grounding clamp 103. As shown base member 201 comprises base 302, vertical support member 301 coupled to the base 302, and oblique riser 303 coupled to the base. Oblique riser 303 is oblique relative to the vertical support member 301, for example, being slightly skewed off a plane parallel to the vertical support member 301. As further shown, head member 202 is coupled to the vertical support member 301 through horizontal support member 304. Horizontal support member 304 is substantially orthogonal to the vertical support member 301. According to some embodiments, the horizontal support member may be omitted, with head member 202 being directly coupled to the vertical support member 301. According to other embodiments, more support members may be included between the head member 202 and the vertical support member 301.

Figure 4B:
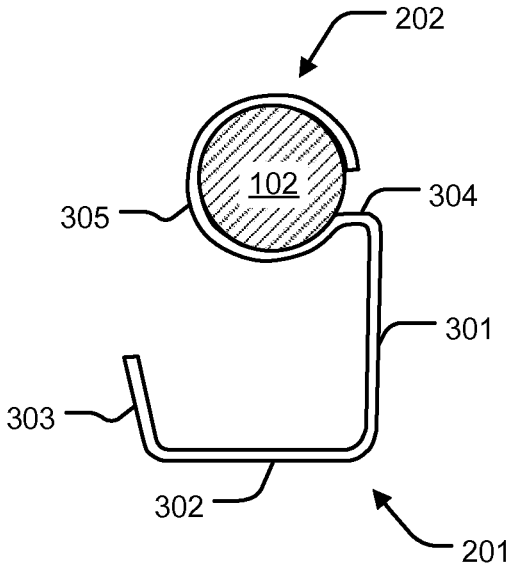
FIG. 4B is a side elevation view of the grounding clamp of FIG. 2 supporting coaxial cable.

FIG. 4B is a side elevation view of the grounding clamp 103 supporting coaxial cable. As shown, coaxial cable 102 is engaged with the clamp 103 and is fully supported. The coaxial cable 102 is routed through head member 202, where electrical contact is established between at least a portion (e.g., 306) of the head member 302 and oblique riser 303. After grounding clamps are engaged with the coaxial cable 102, the entire assembly may be coupled to a substrate 101. Alternatively, the grounding clamps 103 may first be coupled to the substrate 101, processed, and then the coaxial cable 102 may be received.

Hereinafter, a more detailed description of coupling grounding clamps 103 to a substrate and routing coaxial cable 102 is provided with reference to FIGS. 5-7.

Figure 5:
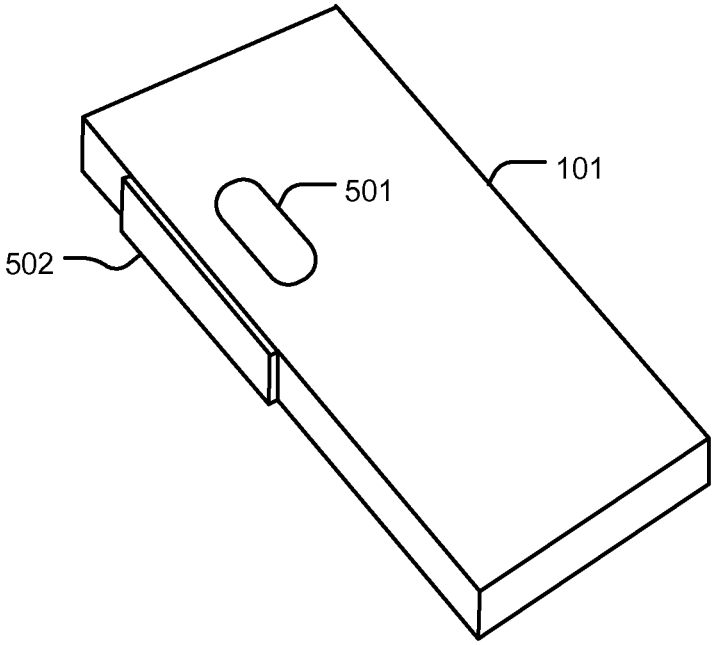
FIG. 5 is a perspective view of a substrate configured to receive the grounding clamp of FIG. 2.

FIG. 5 is a perspective view of a substrate configured to receive the grounding clamp 103. As shown, the substrate 101 may include a plurality of through slots 501 configured to receive and engage with grounding clamps 103. The through slots 501 may be generally elongated through-holes penetrating two major surfaces of the substrate 101. The through slots 501 may be sized slightly larger than a width of a vertical support member of a grounding clamp.

As further illustrated, the substrate 101 includes a plurality of pads 502 arranged on an outer peripheral surface thereof. The pads 502 may be grounding pads in electrical and signal communication with a ground portion or common signal portion of the substrate 101. Alternatively, pads 502 may be supportive pads formed of metal but not in electrical communication with any portion of circuitry of the substrate 101. Alternatively, the pads 502 may be in communication with other portions of circuitry of the substrate 101. During assembly, at least one grounding clamp 103 is rolled about and inserted into through slot 501, and oblique riser 303 is electrically and mechanically coupled to the pads 502 to establish a stable supportive route for the coaxial cable 102. The same is illustrated in FIG. 6.

Figure 6:
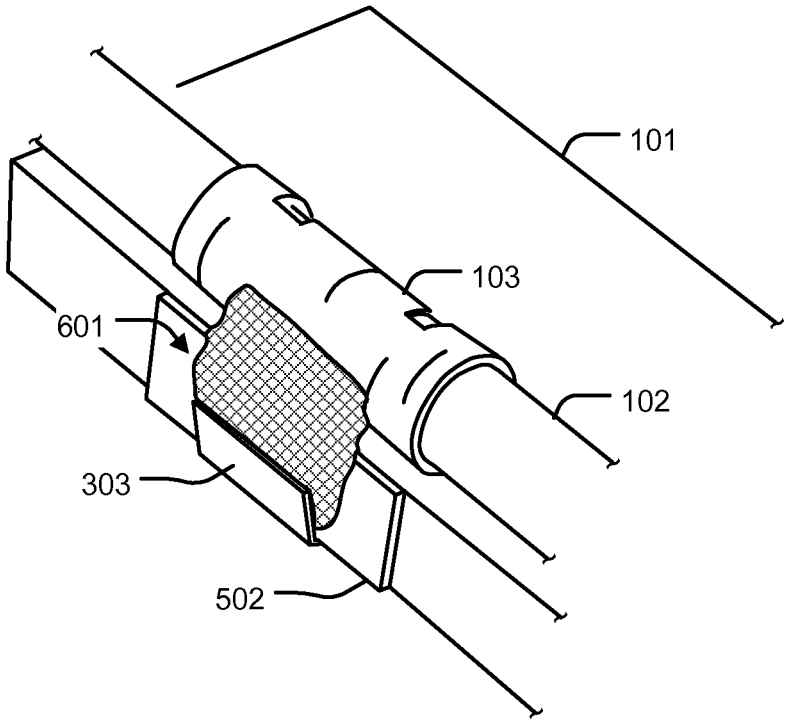
FIG. 6 is a perspective view of the substrate of FIG. 5 with routed coaxial cable and an associated grounding clamp.
Figure 7:
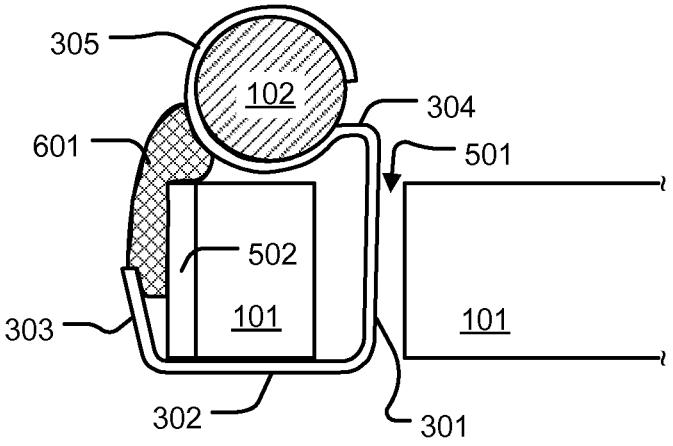
FIG. 7 is a cut-away view the substrate of FIG. 5 with routed coaxial cable and an associated grounding clamp.

FIG. 6 is a perspective view and FIG. 7 is a cut-away view of the substrate 101 with routed coaxial cable 102 and associated grounding clamp 103 coupled thereto. As shown, solder paste, electrically conductive adhesive, amorphous metal alloy or another conductive chemistry 601 is applied to a trough or riser cavity formed between oblique riser 303 and pad 502. The substrate 101 may then be further processed to solidify the chemistry and provide the stable electrical and mechanical coupling described above. For example the substrate 101 may be reflow processed if a solder or solder paste is used. Other processing, treatments, or methods may be used depending upon the chemistry applied to provide mechanical and electrical coupling between the oblique riser 303 and pads 502.

Figure 8:
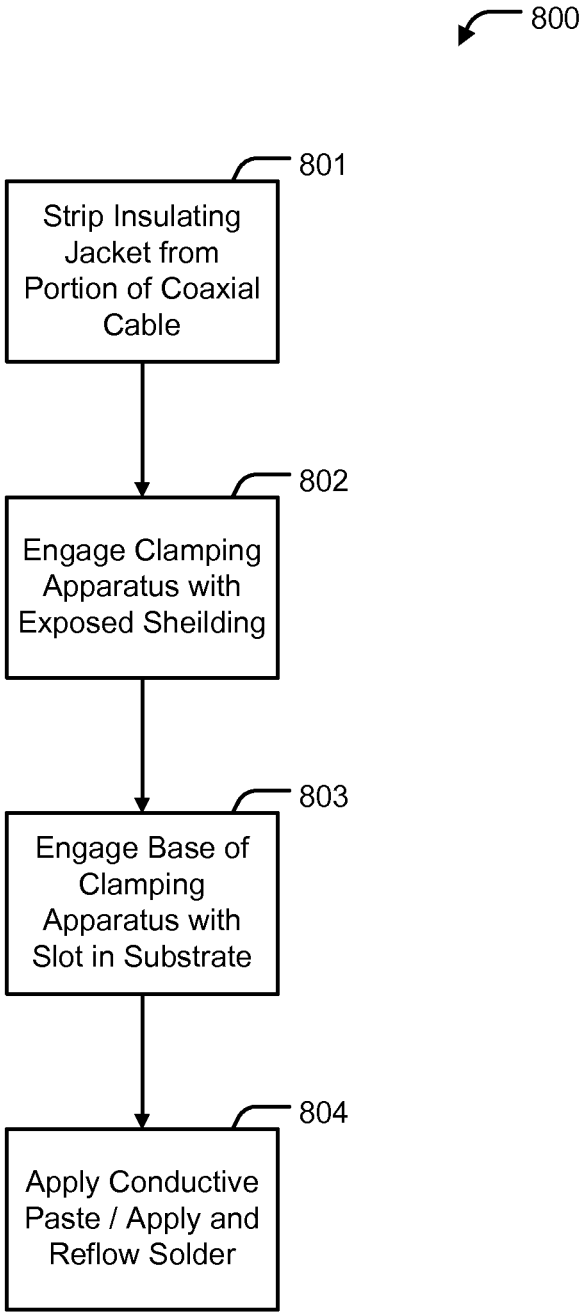
FIG. 8 is a flowchart of a method of routing and grounding a coaxial cable on a substrate using a clamping apparatus, according to an embodiment of the invention.

FIG. 8 illustrates a flowchart of a method 800 for routing a coaxial cable on a substrate, for example, similar to substrate 101 illustrated in FIG. 1. The method 800 includes stripping a portion of insulating jacket from a coaxial cable at block 801. The jacket may be stripped to expose a portion of a shielding or shielding layer from within the coaxial cable. Thereafter, a clamping apparatus similar to apparatus 103 may be engaged with the exposed shielding and coaxial cable at block 802. This, for example, is illustrated in FIGS. 3A-3B. The method further includes engaging a base of the clamping apparatus with the substrate at block 803. The method further includes applying conductive adhesive and/or applying and reflowing solder paste at block 804. This, for example, is illustrated in FIGS. 6-7.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A grounding system for a personal electronic device, the grounding system comprising:

a printed circuit board (PCB) defining a hole, the PCB comprising a conductive pad coupled to an outer peripheral surface of the PCB;

a clamping apparatus, comprising:

a head member comprising an inside surface that substantially surrounds and is electrically coupled with a portion of a coaxial cable, and a base member, comprising:

a first end integrally formed with the head member and extending through the hole defined by the PCB, and a second end that defines an opening in cooperation with an outside surface of the head member; and an amorphous metal that closes the second end opening and is in direct contact with the conductive pad of the PCB so that the coaxial cable is electrically coupled with the conductive pad by way of the clamping apparatus and the amorphous metal.

2. The system of claim 1, wherein the second end of the base member comprises an oblique riser, wherein a trough is defined between the oblique riser and the outer peripheral surface of the PCB.

3. The system of claim 2, wherein the amorphous metal mechanically and electrically couples the oblique riser to the outside surface of the head member.

4. The system of claim 3, wherein the clamping apparatus is formed from a single piece of sheet metal.

5. The system of claim 1, wherein the head member of the clamping apparatus comprises:

an outer portion engaged to an outer jacket of the coaxial cable; and an inner portion engaged to a coaxial shield portion of the coaxial cable.

6. The system of claim 1, wherein an opening defined by the head member opens in a first direction while the second opening opens in a second direction, the second direction being different from the first direction.

7. A clamping apparatus configured to receive a cable and be secured to a printed circuit board (PCB), the clamping apparatus comprising:

a head member defining a first opening, an inside surface of the head member being configured to electrically engage a portion of the cable, wherein the head member substantially surrounds the portion of the cable when the cable is electrically engaged by the head member; and a base member integrally formed with the head member, the base member comprising a distal end that defines a second opening in cooperation with an outside surface of the head member, the second opening leading into a space defined by both the base member and the head member, the space having a size and shape suitable for receiving a portion of the PCB, wherein when the base member passes through a hole defined by the PCB and the portion of the PCB is positioned within the space, the second opening is configured to receive solder that closes the second opening and electrically couples the clamping apparatus to an electrically conductive pathway disposed upon an outer peripheral surface of the PCB.

8. The clamping apparatus as recited in claim 7, wherein the head member comprises:

an inner formation that is configured to electrically engage the portion of the cable, when an outer jacket of the cable is stripped from the portion of the cable; and a plurality of outer formations, each outer formation of the plurality of outer formations being configured to engage an outer jacket of the coaxial cable.

9. The clamping apparatus as recited in claim 7, wherein the first opening is oriented in a first direction while the second opening is oriented in a second direction different than the first direction.

10. The clamping apparatus as recited in claim 7, wherein the distal end of the base member comprises an oblique riser, the oblique riser being configured to cooperate with the portion of the PCB to define a trough.

11. The clamping apparatus as recited in claim 7, wherein the head member comprises:

a plurality of outer portions configured to engage an outer jacket of the cable; and an inner portion configured to electrically engage the portion of the cable when a portion of the outer jacket covering the portion of the cable is stripped away.

12. The clamping apparatus as recited in claim 7, wherein a portion of the base member remains in the hole define by the PCB.

13. The clamping apparatus as recited in claim 12, wherein the portion of the base member is shaped in accordance with the hole defined by the PCB.

14. The clamping apparatus as recited in claim 7, wherein the clamping apparatus is formed from a single piece of sheet metal.

15. A method of electrically coupling a coaxial cable to a circuit board, the circuit board defining a hole, the circuit board including a conductive pathway positioned at one end of the circuit board, the method comprising:

stripping a portion of an outer jacket of the coaxial cable to expose a coaxial shield portion of the coaxial cable;

inserting the coaxial cable through a first opening defined by a head member of a clamping apparatus, wherein the head member substantially surrounds the coaxial cable and electrically engages the exposed coaxial shield portion;

attaching the circuit board to the clamping apparatus by feeding a distal end of a base member of the clamping apparatus through the hole until the clamping apparatus substantially surrounds a portion of the circuit board disposed between the conductive pathway and the hole, the base member being integrally formed with the head member, wherein the distal end of the base member defines a second opening in cooperation with an outside surface of the head member; and depositing solder in the second opening that mechanically and electrically couples the clamping apparatus to the conductive pathway so that the coaxial cable is electrically coupled with the conductive pathway by way of the clamping apparatus and the solder.

16. The method as recited in claim 15, wherein depositing the solder comprises depositing the solder until the second opening is filled and the portion of the circuit board becomes completely surrounded by the clamping apparatus.

17. The method as recited in claim 15, wherein the distal end of the base member comprises an oblique riser, the oblique riser cooperating with the circuit board to define a trough.

18. The method as recited in claim 17, wherein depositing the solder comprises depositing the solder within the trough.

19. The method as recited in claim 15, wherein the clamping apparatus is formed from a single piece of metal.

20. The method as recited in claim 15, wherein the first opening opens in a first direction while the second opening opens in a second direction, the second direction being different than the first direction.

* * * * *